United States Patent [19]

Gamble

[11] Patent Number: 4,864,264

[45] Date of Patent: Sep. 5, 1989

[54] BISTABLE TOGGLING INDICATOR

[75] Inventor: John G. Gamble, Hull, Mass.

[73] Assignee: Sigma Instruments, Inc., Weymouth, Mass.

[21] Appl. No.: 146,040

[22] Filed: Jan. 20, 1988

[51] Int. Cl.[4] ..... H01F 7/08

[52] U.S. Cl. ..... 335/234; 335/272

[58] Field of Search ..... 335/229, 230, 234, 272, 335/276

[56] References Cited

U.S. PATENT DOCUMENTS 3,027,499 3/1962 Holdway .
3,631,366 12/1971 Ugon .
3,634,793 1/1972 Sauer .
3,820,047 6/1974 Juhnke .
3,964,008 6/1976 Davis .
4,286,244 8/1981 Schuessler et al. .
4,296,676 10/1981 Andrews et al. .
4,437,078 3/1984 Bando et al. .
4,437,081 3/1984 Wyatt .

*Primary Examiner*—George Harris
*Attorney, Agent, or Firm*—Stanger, Michaelson, Reynolds, Spivak & Tobia

[57] ABSTRACT

In the disclosed device, a pair of magnets supported in the ends of a C-shaped yoke bias an armature into one of the two rotary positions. A short pulse to a coil about the center of the yoke induces a short term magnetic field that supplements the polarity at one end of the yoke so as to either maintain the armature in its biased position or swing the armature to its other biased position. A subsequent pulse, producing a field in the opposite direction, returns the armature to its first position. In each case, the magnets retain the armature in its biased position even after the pulse stops. The armature pivots between portions of the yoke magnetized by the same magnet.

4 Claims, 3 Drawing Sheets

BISTABLE TOGGLING INDICATOR

BACKGROUND OF THE INVENTION

This invention relates to toggling bistable devices and particularly to electromagnetic indicators for evidencing one of two conditions, such as a "set" or "reset" condition.

In many instances an apparatus must achieve and hold one or another condition in response to a brief signal. For example, a device may need to respond to a short electrical signal and then maintain that response to show whether a system is operating properly or improperly. For such purposes, it is common to use set-reset or "yes" or "no" indicators which retain their position despite cessation of the signal that actuated the indicator.

Many of these indicators and other bistable devices rely upon springs to move a armature into alternate positions and an electromagnetic force to move it between positions. These have been found undesirable for a number of reasons. A number of devices have been disclosed which accomplish results of this nature by biasing an armature in one or the other direction with a permanent magnet. In these types of devices, a winding energized by an indicating circuit induces a magnetic field which overcomes the biasing force of the permanent magnet and shifts the armature into another position where a permanent magnet holds the armature despite the cessation of the current in the field-inducing winding. The proximity of the armature to one of the permanent magnets compared to the distance from the other permanent magnet, assures retention of the armature into one of the two bistable conditions.

While such devices find use in some applications, they are complex, require heavy actuating currents, or are difficult to assemble.

OBJECT AND SUMMARY OF THE INVENTION

An object of the invention is to overcome these difficulties.

Another object of the invention is to improve indicators of this type.

These and other objects of the invention are obtained, in whole or in part, by securing separate biasing permanent magnets at the ends of a yoke that supports the magnetic field produced by a winding surrounding the yoke.

According to another feature of the invention, the yoke terminates in two channels holding separate magnets while a section abutting the ends supports the windings which induce the magnetic fields of the pulses into the yoke.

According to another feature of the invention, each end of the yoke forms two extremities and the respective poles of each permanent magnet magnetically biases one of the extremities. The armature is oriented to swing between the extremities on the same end in response to electrical pulses.

These and other features of the invention are pointed out in the claims. Other objects and advantages of the invention will become evident from the following detailed description when read in light of the accompanying drawings.

DESCRIPTION OF PREFERRED EMBODIMENTS

Figure 1:
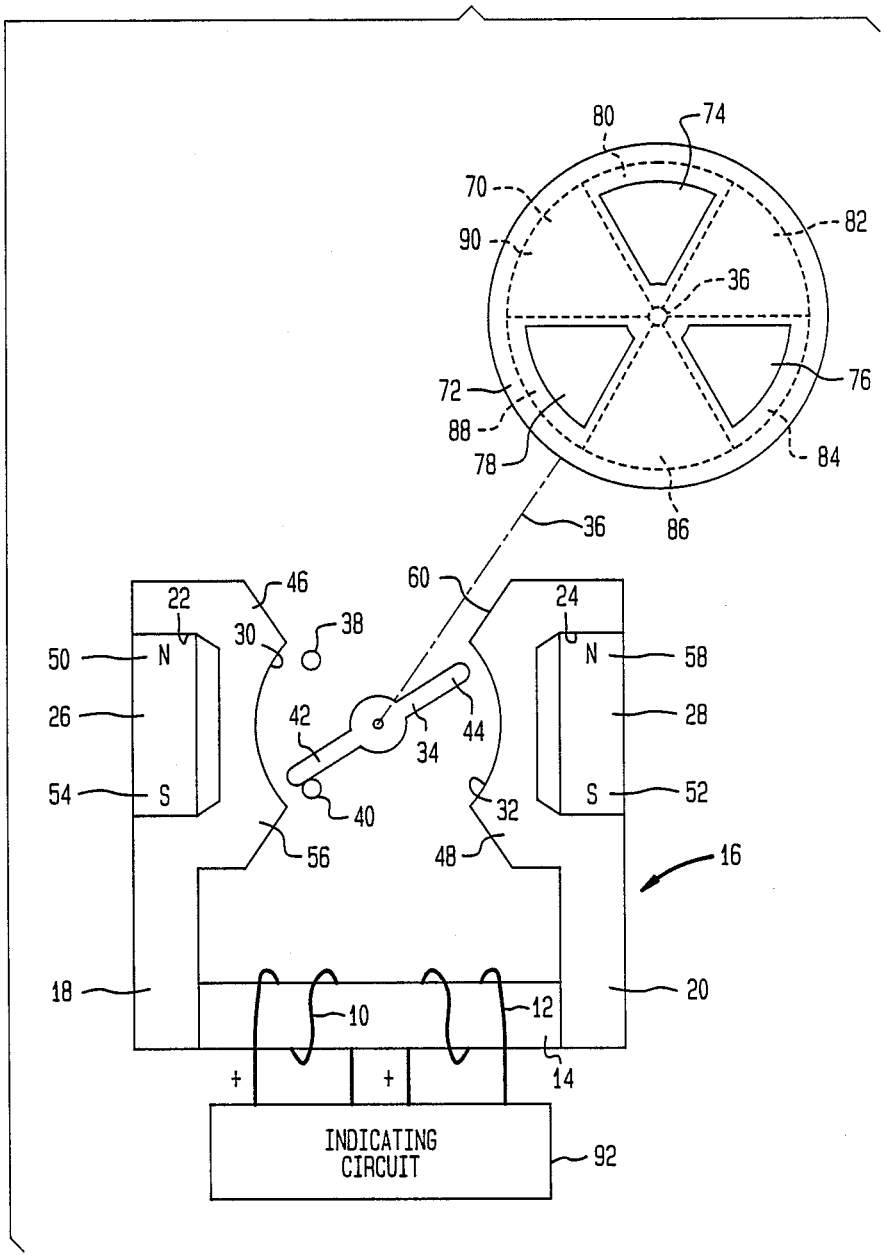
FIG. 1 is a schematic illustration of an indicator device embodying features of the invention.

In FIG. 1, two energizing coils 10 and 12, wound in opposite directions, surround a soft magnetic coil core 14 that constitutes the center section of a magnetic yoke generally designated 16. The yoke 16 terminates in two ladle-shaped magnetically-soft yoke arms 18 and 20 that abut against the ends of the core 14. The yoke arms 18 and 20 form channels 22 and 24 which receive respective permanent magnets 26 and 28 polarized as shown in FIG. 1 so that the North portion is on the upward side of each magnet 26 and 28 while the South pole is at the lower end. Suitable adhesives secure the magnets 26 and 28 within the channels 22 and 24.

Figure 2:
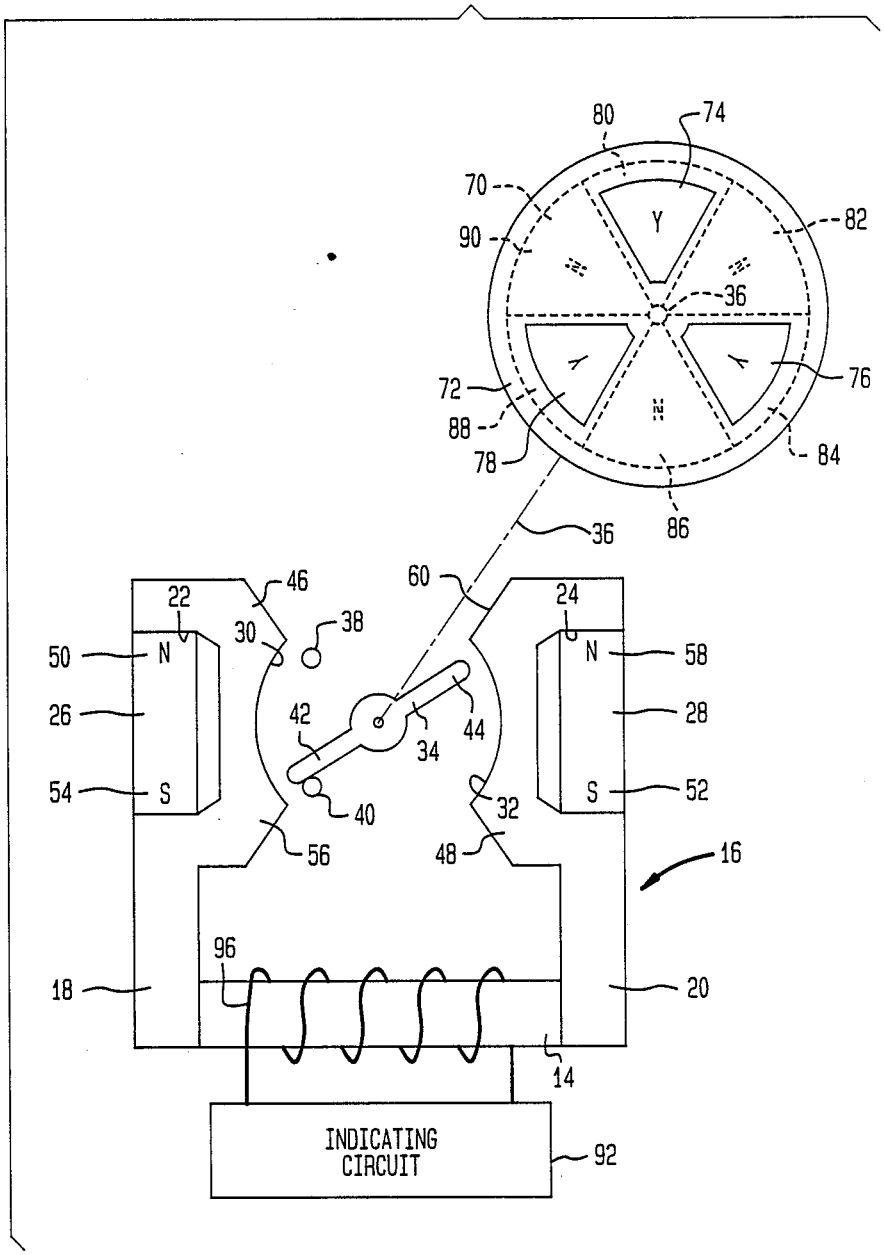
FIG. 2 is a another schematic illustration of a device embodying features of the invention.

The faces of the arms 18 and 20 opposite the magnets 26 and 28 form respective arcs 30 and 32 of a common circle. A soft magnetic armature 34 rotates a shaft 36 at the center of the circle defined by the arcs 30 and 32. In FIGS. 1 and 2, two limit stops 38 and 40 limit the rotation of the armature 34 to approximately 60 degrees. When the armature 34 rests against the limit stop 38, the outer ends 42 and 44 of the armature 34 lie adjacent respective projections 46 and 48 extending from the yoke arm 18 and yoke arm 20. The North pole 50 of the permanent magnet 26 imparts a North polar magnetism to the projection 46 while the South pole 52 of the permanent magnet 28 imparts a South polar magnetism to the projection 48. The poles 50 and 52 of the magnets 26 and 28 thereby tend to magnetically bias the armature 34 into a position in which the end 42 rests against the limit stop 38. This tends to hold the armature 34 in the position shown.

When the armature 34 rests against the limit stop 40 so that its end 42 abuts against the limit stop 40, the South pole 54 of the permanent magnet 26 attracts the end 42 of the armature 34 toward a projection 56 of the yoke arm 18 while the North pole 58 of the magnet 28 causes a projection 60 to attract the end 44 of the armature 34 and hold the end 42 in the position abutting the limit stop 40. This occurs because the South pole 54 imparts a South polar magnetism to the soft magnetic material of the projection 56 while the North pole 58 imparts a North polar magnetism to the soft magnetic material of the projection 60. Hence, the magnets 26 and 28 tend to hold the armature 34 against the particular stop 38 or 40 which the forces of windings 10 or 12 have placed the armature 34.

The shaft 36 is keyed to move with the armature 34 and swing a disk 70 relative to a fixed mask 72. Three sector-shaped openings or windows 74, 76, and 78 in the mask 72 expose portions of the disk 70. A color scheme divides the disk 70 into six 60-degree sectors 80, 82, 84, 86, 88, and 90 of alternating colors such as green for sectors 80, 84, and 88, and red for sectors 82, 86, and 90. The sectors 80 to 90 align relative to the openings 74 and 78 so that when the armature 34 rests against the limit stop 40 only the green sectors 80, 84, and 88 appear in the openings 74, 76, and 78. When the armature 34 swings to the position against the limit stop 38, only the sectors 90, 82, and 86 appear in the openings 74, 76 and 78. Prior to operation, the mask 72 is adjusted and fixed in a position to register with the sectors 80, 84, and 88.

Preferably, the green sectors 80, 84, and 88 contain legends such as "Y" to depict a verbal message "yes" to an observer in addition to a visual color message, while the sectors 82, 86, and 90 carry a legend "N" to depict a "no".

An indicating circuit 92 supplies pulses to the coil 10 to indicate a proper condition or to the coil 12 to indicate an improper position.

In operation, the magnets 26 and 28 bias the armature 34 against one or the other of the limit stops 38 or 40 from any unstable position therebetween so that the shaft 36 swings the disk 70 into a position at which the sectors 80, 84, and 88 or the sectors 82, 86, and 90 appear in the windows 74, 76 and 78. For simplicity, it is assumed that the armature 34 starts in the position shown against the limit stop 38. If the indicating circuit 92 now produces a short pulse through the coil 10 to signify proper operation of the circuit which it monitors, the pulse induces a magnetic field of short duration in the yoke 16. The field augments the North polar magnetization at the magnet 26 and decreases the North polar magnetization at the magnet 28. This simply augments the North polar pull on the end 42 of the armature 34 and the South polar pull on the end 44 of the armature 34. Hence, the armature 34 remains in its prebiased position. The shaft 36 keeps stationary at a position exposing the green sectors with the legend "Y" through the openings 80, 84, and 88.

When the indicating circuit 92 applies a pulse to the coil 12 signifying an improper condition, it induces a magnetic field of short duration in the yoke 16. The thus induced short term magnetic field augments the North polar magnetization at the magnet 28 and augments the South polar magnetization at the permanent magnet 26. The indicating circuit 92 produces these pulses so they are sufficiently strong to overcome the North polar pull of the magnet 26 and the South polar pull of the magnet 52 and thereby induces the armature 34 to swing against the limit stop 40 and turn the shaft 36 so as to expose the red sectors 90, 82, and 86 with the legend "N" at the openings 74, 76 and 78. When the pulse ends, the biasing forces of the North pole 58 on the magnet 28 and South pole 54 on the magnet 26 attract the end 42 and the end 44 so that the armature 34 remains against the limit stop 40. The remoteness of the ends 42 and 44 from the respective projections 46 and 48 prevent their turning the armature back against the limit stop 38.

If the indicating circuit 92 again produces a short pulse through the coil 10 to signify a proper condition, the pulse induces a magnetic field of short duration in the yoke 16. The field supplements the North polar magnetization of the magnet 26 and the South polar magnetization of the magnet 28. The indicating circuit produces the pulse and field so they are strong enough to swing the armature clockwise against the limit stop 38. The North pole 50 of the magnet 26 and the South pole 52 of the magnet 28 hold the armature 34 against the limit stop 38 even after the pulse has ended. The swing of the armature 34 against the limit stop 38 drives the shaft 36 to move the sectors 80, 84, and 88 into the openings 74, 76 and 78.

A succeeding pulse through the coil 12 returns the armature 34 clockwise against the limit stop 40. This swings the shaft 36 and the sectors 90, 82, and 86 into the windows 74, 76 and 78.

FIG. 2 indicates another embodiment of the invention. Here, a single coil 94 replaces the coils 10 and 12. The indicating circuit 92 produces a positive pulse at a wire 96 to induce a North pole at the channel 22 and thereby swing the armature 34 against the terminal 38 to expose the sector 80, 84, and 88 in the openings 74, 76, and 78. This occurs in response to an indication of proper system operation. In response to improper system operation, the indicating circuit 92 produces a pulse in the opposite direction, namely, a positive pulse at the wire 96, to induce a North polar field at the channel 24 and thereby swing the armature 34 against the terminal 40 so the shaft 36 turns the disk 70 to expose the sectors 90, 82, and 86 in the openings 74, 76 and 78.

Figure 3:
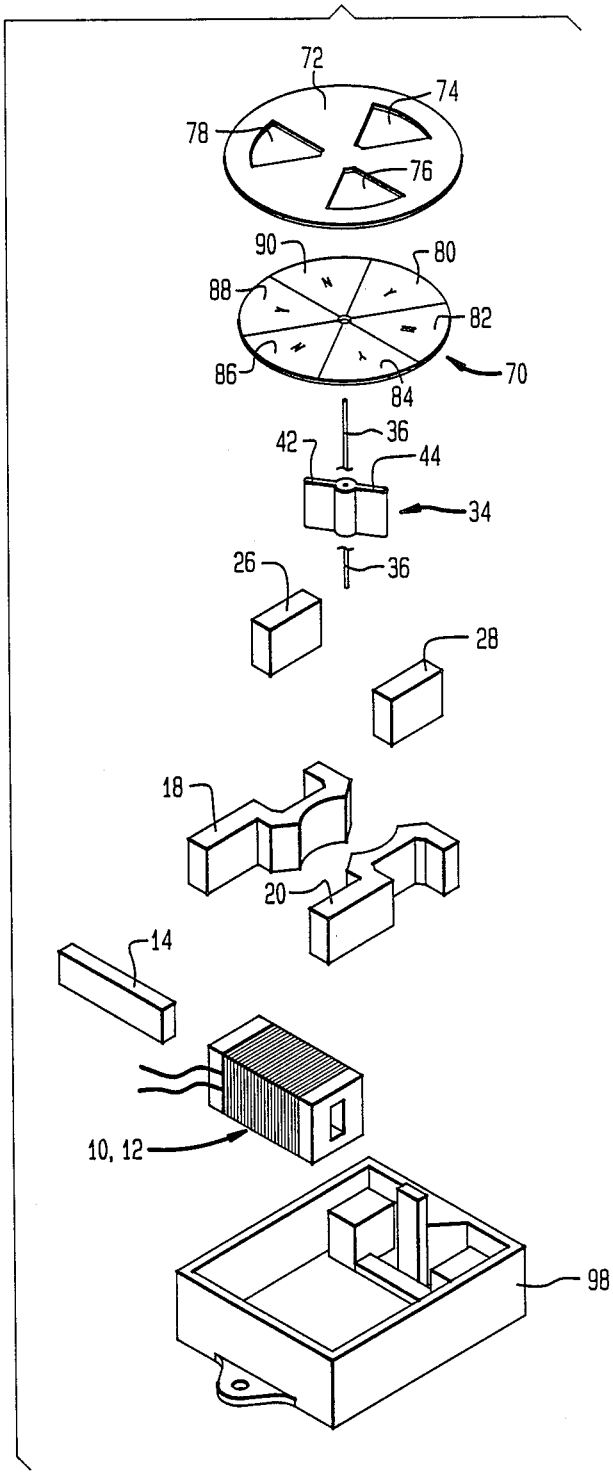
FIG. 3 is an exploded view of the device in FIG. 1.

FIG. 3 is an exploded perspective view illustrating the indicator of FIG. 1. Here, the coils 10 and 12 surround the coil core 14 which abuts the yoke arms 18 and 20. Permanent magnets 26 and 28 slide into the channels formed in the portions 22 and 24 of the yoke ends 18 and 20. The armature 34 turns the shaft 36 which in turn swings the disk 70 behind the mask 72 and its windows 74, 76 and 78. The entire assembly fits into a case 98.

The invention involves a minimum number of parts which are easily assembled within a case. The permanent magnets 26 and 28 need merely be rectangular and fit into suitable recesses in easily fabricated, soft-magnetic material. The invention also reduces the energy required of the pulses for swinging the armature from on position to the other.

According to other embodiments of the invention, the angle of swing of the armature and hence the disk 70 is adjusted to other desired angles.

While embodiments of the invention have been described in detail, it will be evident that the invention may be embodied otherwise without departing from its spirit and scope.

What is claimed is:

1. An indicator comprising:

a yoke of soft magnetic material having a pair of ends with only a single yoke section connecting said ends, said yoke forming a channel at each of said ends, an armature of soft magnetic material pivoted between said ends, magnet means for biasing said armature in one of two directions toward one of two positions, and electrical winding means coupled to said yoke for producing a field to overcome the biasing force of said magnet means and moving said armature from one of said positions to the other of said positions, said magnet means including two magnets, each positioned in one of said channels, for causing said yoke to move said armature toward one or the other position.

2. An indicator as in claim 1, wherein one of said magnets produces a magnetic field of one polarity at one position and the other of said magnets produces a magnetic field of the same polarity at the other position.

3. An indicator as in claim 1, wherein said yoke includes a pair of projections at each of said ends, said magnets in the channels of each of said ends polarizes the projections at the respective ends, and said armature is arranged to swing between the pair of projections at one of said ends 4. An indicator as in claim 2, wherein said armature is also arranged to swing between the pair of projections at the other of said ends.

* * * * *